US007922034B2

(12) United States Patent
Neveu et al.

(10) Patent No.: US 7,922,034 B2
(45) Date of Patent: Apr. 12, 2011

(54) PAPER DISPENSER

(75) Inventors: Jean-Louis Neveu, Colmar (FR); Nicolas Pommier, Colmar (FR); Philippe Guillemette, Caen (FR)

(73) Assignee: Georgia-Pacific France (FR)

( * ) Notice: Subject to any disclaimer, the term of this patent is extended or adjusted under 35 U.S.C. 154(b) by 0 days.

(21) Appl. No.: 12/093,356

(22) PCT Filed: Nov. 7, 2006

(86) PCT No.: PCT/FR2006/002473

§ 371 (c)(1),
(2), (4) Date: May 12, 2008

(87) PCT Pub. No.: WO2007/057537

PCT Pub. Date: May 24, 2007

(65) Prior Publication Data

US 2008/0283546 A1 Nov. 20, 2008

(30) Foreign Application Priority Data

Nov. 18, 2005 (FR) ..... 05 53507

(51) Int. Cl.

| | |
|---|---|
| ***A47K 10/24*** | (2006.01) |
| ***B65H 1/00*** | (2006.01) |
| ***B65H 75/00*** | (2006.01) |
| ***B65H 16/02*** | (2006.01) |
| ***B65H 18/02*** | (2006.01) |

(52) U.S. Cl. ..... 221/45; 221/33; 221/63; 221/62; 221/1; 220/253; 220/265; 220/269; 220/258; 242/593; 242/615.3; 225/46; 312/34.8

(58) Field of Classification Search ..... 242/593, 242/615.3; 220/253, 265, 269, 258; 225/46; 221/45, 1, 62, 63, 33; 312/34.8
See application file for complete search history.

(56) References Cited

U.S. PATENT DOCUMENTS

| | | | | |
|---|---|---|---|---|
| 6,109,473 | A | 8/2000 | Neveu et al. | |
| 6,145,782 | A * | 11/2000 | King et al. | 242/593 |
| 6,267,321 | B1 * | 7/2001 | Tramontina | 242/593 |
| 6,328,252 | B1 * | 12/2001 | Neveu et al. | 242/593 |
| 6,332,551 | B1 * | 12/2001 | Copeland | 220/262 |
| 6,575,397 | B1 * | 6/2003 | Tramontina et al. | 242/593 |
| 6,592,001 | B2 * | 7/2003 | Lewis et al. | 221/33 |
| 7,131,609 | B1 * | 11/2006 | Lewis et al. | 242/593 |
| 7,275,672 | B2 * | 10/2007 | Haen et al. | 225/106 |
| 7,287,720 | B1 * | 10/2007 | Allegre et al. | 242/593 |
| 7,370,826 | B2 * | 5/2008 | Neveu | 242/593 |
| 7,510,137 | B2 * | 3/2009 | Tramontina et al. | 242/593 |

FOREIGN PATENT DOCUMENTS

| | | |
|---|---|---|
| FR | 2761252 A1 | 10/1998 |
| GB | 2063213 A | 6/1981 |

OTHER PUBLICATIONS

Unpublished U.S. Appl. No. 11/866,506, filed Oct. 3, 2007. International Search Report for PCT/FR2006/002473 that issued Apr. 18, 2007.
Written Opinion of the International Search Authority for PCT/FR2006/002473.

* cited by examiner

*Primary Examiner* — Gene O. Crawford
*Assistant Examiner* — Rakesh Kumar
(74) *Attorney, Agent, or Firm* — Joel T. Charlton

(57) ABSTRACT

A paper dispenser includes a casing for housing a roll of paper, the casing having a front face, with a dispensing nozzle through which the paper is dispensed, wherein the front face has a hatch for access to the inside of the casing, through which a free end of the roll can be extracted.

6 Claims, 1 Drawing Sheet

PAPER DISPENSER

Figure 1:
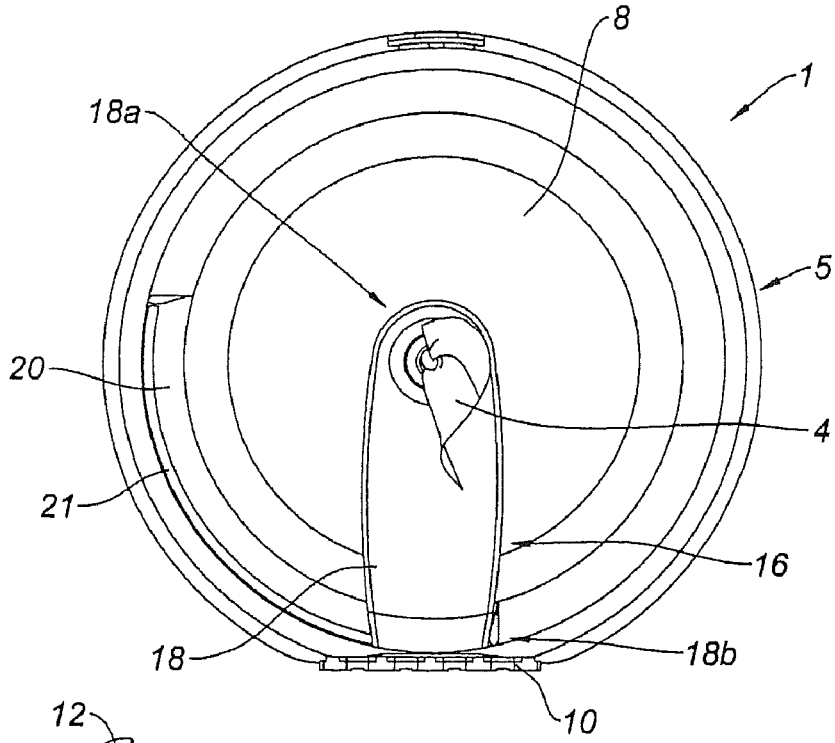

The present application claims priority to French Patent Application No. 0553507 filed on Nov. 18, 2005, which is incorporated herein in its entirety.

The invention relates to the field of sanitary and domestic paper and concerns a dispenser for paper in rolls, particularly toilet paper.

In public places, in particular, a toilet paper dispenser generally comprises a casing in which is mounted a roll of paper strip which is unwound through a dispensing aperture. The paper strip has pre-cuts which are transverse with respect to the direction of its unwinding, forming sheets which can be detached individually. Toilet paper is a cellulose wadding paper with a soft and gentle surface, comprising one or more plies with a substance usually in the range from 14 g/cm$^2$ to 30 g/cm$^2$ approximately.

The most commonly used dispensers have an aperture, or window, at least as wide as the toilet paper, in a low position on the dispenser, through which the paper is unwound. Unwinding is carried out by pulling the free end of the paper which is on the outer layer of the roll: in this case, we speak of peripheral unwinding of the paper. When the user has obtained a certain quantity of paper, he can cut it off, for example by using a cutting edge of the dispenser aperture.

For the owner of the paper dispenser, and consequently for its designer, one of the principal aims to be borne in mind for the determination of the characteristics of the dispenser and its roll is that of minimizing paper consumption. The drawback of the device described above is the fact that the user is free to unwind a large quantity of paper sheets by continuously pulling the end of the strip. This freedom for the user is manifested statistically in a considerable wastage of paper, since the user unwinds more paper than he needs.

One solution is to oblige the user to unwind the paper sheet by sheet. Sheet by sheet dispensers with central unwinding have been proposed in the prior art, particularly in the field of kitchen paper or wiping paper, for example in factories. In these dispensers, the paper is unwound from the centre of the roll and extracted through the aperture of a nozzle placed in the axis of the roll or on the periphery of the dispenser, the nozzle generally being of truncated conical shape and having a small outlet cross section to ensure sheet by sheet dispensing. This process is described as central unwinding of the paper, sheet by sheet in this case. An example of this type of dispenser is described in FR 2,761,252.

With these dispensers, the user cannot unwind large quantities of paper, and his consumption is therefore reduced. The casing of the dispenser is generally closed, with a secure locking means, the key to which is held, for example, only by persons responsible for cleaning, so that they can replace the rolls.

Thus the dispenser takes the form of a closed casing with an unwinding aperture through which the paper can only emerge sheet by sheet. The paper is thus effectively protected from excessively rapid unwinding.

However, these dispensers have the following drawback: if the paper becomes jammed inside the casing or the dispensing nozzle, or if the paper no longer projects from the aperture of the unwinding nozzle, the user has no way of grasping the paper in the nozzle or pulling it up in order to resolve the problem. The solution would be to allow the user to open the casing, but this is undesirable for various reasons, particularly for reasons of hygiene.

Furthermore, even if the user were allowed to open the case, for example if the locking means were not secure, it would be undesirable for the user to do so, since there would then be a risk that the partially unwound roll would collapse and become unusable.

The object of the present invention is to resolve this problem and to propose a paper dispenser which allows the user to resolve problems of paper jamming, but does not allow him to steal the roll, and, in all circumstances, leaves the roll in a condition such that it remains usable.

For this purpose, the invention relates to a paper dispenser, particularly for toilet paper, comprising a casing for housing a roll of paper, the casing having a front face with a dispensing nozzle through which the paper is unwound sheet by sheet, and means of locking the front face to the casing, characterized in that the front face has a hatch for access to the inside of the casing, through which the free end of the roll can be extracted.

Because of the invention, the paper is well protected by the locked front face and a user cannot steal the roll if the lock is made secure. Furthermore, the roll is unwound sheet by sheet through the nozzle, thus preventing any excessively rapid unwinding of the paper. If the paper becomes jammed inside the casing or if the free end of the paper strip no longer projects from the aperture of the nozzle, the user can access the inside of the casing without unlocking and opening the front face, by opening the hatch, in order either to release the paper or reinsert it in the nozzle, or to directly extract the free end of the roll to unwind the paper through the hatch.

Preferably, the hatch has a closing means designed to be movable between a closed and an open position.

In this case, the closing means is preferably returned to the closed position and held there by a means forming a spring. Thus the hatch is closed by default, which contributes to the maintenance of hygiene for the whole assembly and ensures that the hatch is only used occasionally.

Advantageously, the hatch has a cut-out and a sliding member, mounted rotatably between a closed position and an open position of the cut-out.

Also advantageously, the sliding member is guided by a groove of the casing, which imparts a high degree of compactness and strength to the assembly, the sliding member being incorporated more closely in the casing, making it difficult to remove therefrom.

Again advantageously, the sliding member is mounted rotatably about the axis of the casing.

In one embodiment, the sliding member is mounted on the face of the casing at the position of an aperture in which the dispensing nozzle is engaged.

In a particular embodiment, the dispenser has a means for locking the closing means in the closed position.

In one embodiment, the locking means includes a strip designed to be housed in the groove.

The invention is particularly applicable to a toilet paper dispenser, but it can be applied to other types of paper, such as hand wipes or kitchen paper.

Figure 2:
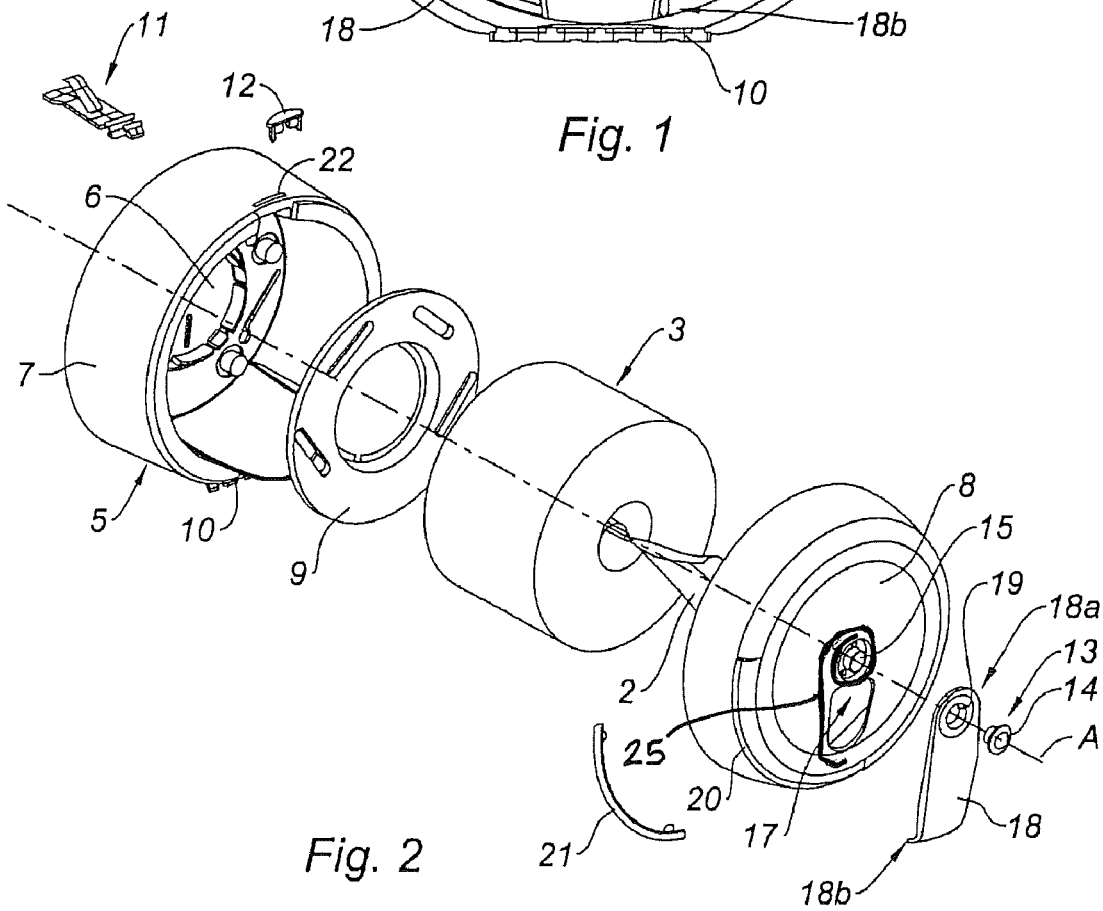

The invention will be more clearly understood with the aid of the following description of a non-restrictive embodiment of the dispenser according to the invention, with reference to the attached drawing, in which:

FIG. 1 shows a front view of the dispenser according to the invention with a sheet of paper in the course of being unwound, and FIG. 2 is an exploded perspective view of the various elements of the dispenser according to the invention, with a roll of paper.

With reference to FIG. 1, the dispenser 1 according to the invention is a toilet paper dispenser. The toilet paper is a cellulose wadding paper, having for example two plies or layers which may or may not be joined together by any appropriate mechanical or chemical means, for example by knurling or bonding, in a way well known to those skilled in the art. With reference to FIG. 2, the toilet paper takes the form of a strip 2 which is wound into a roll 3, the latter not having any central inner core when it is housed in the dispenser 1, either because the roll is designed without a core, or because the core is removed from the roll 3 immediately before it is placed in the dispenser 1. The paper is initially wound in such a way that the free end 4 of the strip 2 projects beyond the central part of the roll 3 before it can be unwound from it. The strip 2 has pre-cuts 4, parallel to the axis of the cylinder formed by the roll 3, delimiting pieces of paper which can be detached individually.

The dispenser 1 comprises a casing 5, of substantially cylindrical shape, for receiving the roll 3, which is also of cylindrical shape. The casing 5 has a base 6, a circumferential lateral wall 7, and a front face 8. The base 6 includes means (not shown) for fastening to a support, for example to a wall of the room in which the dispenser 1 is to be placed, these means being designed in such a way that, when the dispenser has been attached, the axes of the casing 5 and the roll 3 are perpendicular to the wall; these axes necessarily coincide if the cylinders formed by the casing 5 and the roll 3 are coaxial, or at least parallel. In this case they coincide in an axis A.

The casing 5 is designed in such a way that the roll 3 does not rotate on its axis A while being unwound. For this purpose, a plate 9 for holding the roll 3 is mounted on the base 6 of the casing 5. Typically, means forming a spring are positioned between the base 6 of the casing 5 and the holding plate 9, so that the latter pushes the roll 3 against the inner surface of the front face 8, which prevents it from rotating and keeps it in shape to prevent it from collapsing when it is unwound.

When the holding plate 9 is in position and the roll 3 is housed in the casing 5, the front face 8, which is mounted pivotably on a hinge 10, in this case positioned on a lower part of the casing 5, is closed in order to close the casing 5. This front face 8 is then locked with the aid of a locking member 11 which is mounted in the casing 5 and is latched on to the front face 8 to lock it. The locking means 11 interacts with an unlocking key 12.

The unlocking key 12 can be made secure, in other words can be accessible only to a restricted group of persons, or can be mounted permanently on the casing 5 so that it can be actuated by anyone.

Thus, if it is made secure, only certain persons possess this unlocking key 12. The front face 8 is thus locked in the closed position by the locking member 11 and cannot be opened by the user. Authorized persons, for example the persons responsible for replacing the rolls 3, can use their unlocking key 12, which they insert into a slot 22, provided for this purpose in the lateral wall 7 of the casing 5, the key 12 then pushing on the locking member 11, which unlocks the front face 8.

The unlocking key 12 can also be mounted permanently on the dispenser 1. In this case, the key 12 is inserted into the slot 22 and remains in position therein. The key 12 can, for example, include a push button which, when actuated, pushes the locking member 11, which releases the front face 8 which can be opened. Thus the casing 5 can be opened by anyone, by pressure on the push button.

The means 11 for locking the front face in the closed position and the unlocking means 12 are not described further, since they are well known to those skilled in the art and can be of any type.

The front face includes a paper dispensing nozzle 13, in a central position in this case. This nozzle 13 is, for example, of truncated conical shape, its aperture with the smaller diameter being the outlet aperture, or dispensing aperture 14, located on the outer side of the nozzle 13 with respect to the casing 5. The nozzle 13 is mounted on a corresponding aperture 15 of the front face 8. The free end 4 of the strip 2, starting from the centre of the roll 3, is inserted into the nozzle 13 so as to project through its dispensing aperture 14. When a user pulls on the end 4 of the strip 2 projecting from the nozzle 13, the strip 2 is unwound from its centre. The diameter of the dispensing aperture 14 of the nozzle 13 and the sheets of paper interact in such a way that the dispensing takes place sheet by sheet, in a known way.

The front face 8 also includes a hatch 16, formed by a cut-out 17, or opening 17, in the front face 8, and a movable means 18 for closing the cut-out 17. The term "movable" denotes that the closing means can be released from its closed position, either by being effectively taken off the casing 5, in other words by being removable, or by being moved from a closed position to an open position in which access to the cut-out 17 is possible.

In this case, the cut-out 17 is of substantially rectangular shape with rounded corners, its dimensions being selected in such a way that a user can put his fingers into it. The closing means 18 of the hatch 16 closes the hatch 16 in the normal position and can be moved so as to free the cut-out 17.

In one embodiment, the closing means 18 takes the form of a sliding member 18, of overall rectangular shape in front view, whose dimensions are greater than or equal to those of the cut-out 17 of the hatch 16, in order to block it. The sliding member 18 extends between the central part of the front face 8 and its edge connected to the lateral face 7. It is fixed, with a degree of freedom in rotation, in a central position on the front face 8, by means of an aperture 19 located at one of its ends 18*a*. For this purpose, the aperture 19 is held between the front face 8 and the nozzle 13, which is engaged and locked in the aperture 19. The sliding member 18 is thus fixed to the casing 5 by means of its aperture 19, and can rotate about the axis A of the casing 5. The sliding member 18 extends across the whole radius of the front face 8 and its other end 18*b* is located on the edge of this front face 8. This face has a groove 20, on a portion of its circumference, in which the end 18*b* of the sliding member 18 is slidably mounted. In this case, the shape of this end 18*b* is curved in the direction of the base 6 of the casing 5, the groove 20 having a complementary shape. This configuration imparts a good degree of compactness to the assembly, as well as a good degree of strength, since it is difficult to pull the sliding member 18 off the casing 5 owing to the absence of graspable projecting elements.

Thus the sliding member 18 can rotate about the axis A of the casing 5, on the outer surface of the front face 8, its end 18*b* being guided by the groove 20. The sliding member 18 can therefore be moved either to a position in which it closes the cut-out 17 of the hatch 16, or to an open position in which the cut-out 17 is freely accessible. This makes it possible to open the hatch 16 and access the inside of the casing 5 if the paper is jammed in the dispenser 1, or if the paper breaks so that its free end 4 is inside the casing 5 or is jammed and inaccessible in the nozzle 13. The user can then either replace the free end 4 of the strip 2 in the nozzle 13 in the appropriate way, or unwind the paper directly through the cut-out 17 of the hatch 16 by extracting the free end 4 of the strip 2 through this cut-out 17.

If the unlocking key 12 is not mounted permanently on the casing 5 and is only held by specified persons, the user can catch hold of the free end 4 of the strip 2 through the hatch, but cannot extract the roll 3 from the casing 5, since the dimensions of the cut-out 17 do not permit the passage of the roll 3.

If the unlocking key 12 is mounted permanently on the casing 5, and is not made secure, the user would be sure of being able to open the front face 8 of the casing. However, it is not desirable for him to do so. This is because, in these circumstances, there would be a risk that the partially unwound roll 3 would collapse and become unusable, since it is correctly kept in shape by being pressed between the holding plate 9 and the front face 8. If the roll 3 should collapse, it would be impossible to restore its shape thereafter, and the roll would be wasted. It is therefore desirable that the casing 5 is not reopened, after the roll 3 has been placed inside it, until the paper runs out. The hatch 16 makes this possible. When he sees the hatch 16, the user will be induced to use it rather than to attempt to open the front face 8 by pressing the push button at the top of the casing 5. It is also possible to expressly induce the user to act in this way, for example by providing visual instructions.

Since the hatch 16 is closed during normal operation, the casing 5 is kept sealed, ensuring that the paper is well preserved and kept in good condition, being protected in particular from damp and soiling.

In a particular embodiment, such as that shown in the figures, a curved strip 21 is provided to lock the sliding member 18 in the closed position. The strip 21 is designed to be housed in the groove 20, when the sliding member 18 is in the position in which it closes the hatch 16, so as to prevent the rotation of the sliding member in the groove 20. If the hatch 16 has to be opened, the strip is disengaged from the groove 20 and the sliding member 18 can be moved so as to free the cut-out 17. The dispenser 1 is therefore adaptable by its owner. If the owner does not wish the users to be able to open the hatch 16, he puts the strip 21 in place. On the other hand, if he authorizes the users to open the hatch 16, he does not provide any means 21 for locking the sliding member 18, such as the strip 21, and the sliding member 18 can be freely moved by the user between the position in which it opens the cut-out 17 and the position in which it closes it.

In a preferred embodiment, a means forming a spring 25 can be positioned, for example at the end 18*a* of the sliding member 18 forming the center of rotation of the sliding member 18, so as to force the sliding member 18 into its closed position, When the hatch 16 has to be opened, the sliding member 18 is moved, against the action of the means forming a spring 25, so as to free the cut-out 17 and so that the user can insert his fingers into the casing 5. On completion of the operation, the sliding member 18 returns automatically to its closed position. Thus any excessively rapid unwinding of the paper is prevented even more effectively, since the sliding member 18 is always in the closed position unless the user acts against the means forming a spring 25.

Such an optional means forming a spring can be of any appropriate shape, performing a function of returning the movable closing means 18 to its closed position and keeping it there, by exerting a return force against which the user can actuate the closing means 18 to move it to the open position, the said closing means 18 returning automatically to the closed position after the use of the hatch 16. Clearly, this means forming a spring can be combined with a means 21 for locking the movable closing means 18 in the closed position. When the locking means 21 is disabled, the user can freely open the closing means 18 against the return force of the means forming a spring.

Clearly, any other form or arrangement of the hatch 16 can be provided, as long as the hatch has an aperture 17 for access to the inside of the casing 5 and a means 18 for closing the hatch 16. Thus the closing means could be removable, in other words engaged with the cut-out 17 of the hatch 16, and taken off to open the hatch 16. As described with reference to the preferred embodiment, this closing means is preferably mounted to be movable between a closed position and an open position, so that it always remains mounted on the casing 5. The movement of the closing means could be different, for example a rectilinear sliding movement, or a pivoting movement such as that of a door.

The preferred embodiment, described with reference to the figures, has the advantage of a good degree of compactness, since the closing means 18 rotates on the surface of the front face 8, about the axis of the casing, and is kept in place without supplementary means, simply by using the dispensing nozzle 13.

The invention claimed is:

1. A paper dispenser comprising a casing for housing a roll of paper, the casing having a front face, with a dispensing nozzle through which the paper is dispensed, wherein the front face has a slidably actuatable hatch for access to the inside of the casing, through which a free end of the roll can be extracted;

wherein the slidably actuatable hatch comprises an opening, and a closing means, the closing means being movable between a closed position and an open position with respect to the opening;

wherein the opening is distinct from the dispensing nozzle such that the paper is dispensed through either the dispensing nozzle or the opening, but not through both the dispensing nozzle and the opening simultaneously;

wherein the closing means is returned to its closed position and kept there by a means forming a spring;

and further comprising a means for locking the closing means in the closed position.

2. The paper dispenser according to claim 1, wherein the locking means includes a strip designed to be housed in the groove.

3. The paper dispenser according to claim 1, further comprising means for locking the front face to the casing.

4. A paper dispenser comprising a casing for housing a roll of paper, the casing having a front face, with a dispensing nozzle through which the paper is dispensed, wherein the front face has a slidably actuatable hatch for access to the inside of the casing, through which a free end of the roll can be extracted;

wherein the slidably actuatable hatch comprises an opening, and a closing means, the closing means being movable between a closed position and an open position with respect to the opening;

wherein the opening is distinct from the dispensing nozzle such that the paper is dispensed through either the dispensing nozzle or the opening, but not through both the dispensing nozzle and the opening simultaneously;

wherein the closing means is returned to its closed position and kept there by a means forming a spring;

wherein the hatch has a cut-out and a sliding member, mounted to be rotatable between a position in which the cut-out is open and a position in which it is closed.

5. The paper dispenser according to claim 4, wherein the sliding member is guided by a groove of the casing.

6. The paper dispenser according to claim 4, wherein the sliding member is mounted on the front face of the casing at the position of an aperture in which the dispensing nozzle is engaged.

* * * * *